US006474894B1

(12) United States Patent
Baik

(10) Patent No.: US 6,474,894 B1
(45) Date of Patent: Nov. 5, 2002

(54) WRITING UTENSIL WITH CONTAINER FOR RECEIVING TEMPORARILY WRITING LIQUID

(75) Inventor: Man-Wha Baik, Inchon (KR)

(73) Assignee: Morris Pen Manufacturing Co., Ltd., Inchon (KR)

( * ) Notice: Subject to any disclaimer, the term of this patent is extended or adjusted under 35 U.S.C. 154(b) by 0 days.

(21) Appl. No.: 09/965,331

(22) Filed: Sep. 25, 2001

(30) Foreign Application Priority Data

Jun. 29, 2001 (KR) ..... 01-19615

(51) Int. Cl.[7] ..... B43K 5/18

(52) U.S. Cl. ..... 401/225; 401/227; 401/198; 401/223

(58) Field of Search ..... 401/225, 223, 401/224, 226, 227, 228, 229, 198, 199

(56) References Cited

U.S. PATENT DOCUMENTS 4,556,336 A * 12/1985 Sano et al. ..... 401/225
5,944,438 A * 8/1999 Koyama et al. ..... 401/225
5,951,187 A * 9/1999 Hsieh ..... 401/225
6,095,707 A 8/2000 Kaufmann
6,340,259 B2 * 1/2002 Mito et al. ..... 401/225

* cited by examiner

*Primary Examiner*—David J. Walczak
(74) *Attorney, Agent, or Firm*—Blakely, Sokoloff, Taylor & Zafman LLP

(57) ABSTRACT

A writing utensil has a container for receiving temporarily a writing liquid oversupplied from a reservoir. A plurality of liquid staying pieces are formed on the outer periphery of the container in layers at a regular distance. A liquid supplying passage is formed along the central axis of the container. A through-hole is formed at a wall of the container for communicating a space formed by the staying pieces with the supplying passage. Upward guiding slits are formed vertically in a straight line at the staying pieces. A tension generating space is formed on the outer periphery of the container diametrically opposite to the upward guiding slits. A pair of downward guiding protrusions are formed longitudinally in the tension generating space and provide a downward guiding groove therebetween. A downward guiding slit is formed at the uppermost staying piece while being aligned with the downward guiding groove.

8 Claims, 7 Drawing Sheets

WRITING UTENSIL WITH CONTAINER FOR RECEIVING TEMPORARILY WRITING LIQUID

BACKGROUND OF THE INVENTION

1. Field of the Invention

The present invention relates to a writing utensil, and more particularly, to a writing utensil with a container for receiving temporarily a writing liquid oversupplied from a liquid reservoir and returning the liquid to the reservoir.

2. Description of the Related Art

Generally, a writing utensil is structured such that a writing liquid stored in a liquid reservoir is consumed through a writing tip and air is automatically replaced within the liquid reservoir according to the amount of liquid consumed and the corresponding decrease in an inner pressure, to thereby make the writing liquid consumed continually.

When the inner pressure of the liquid reservoir increases due to an exterior shock or a rise in the inner temperature, the writing liquid in the reservoir overflows toward a liquid container through an air inlet and stays temporarily in the container. In this stay condition, when the inner pressure of the reservoir is reduced or the liquid is further consumed, the liquid staying in the container returns to the reservoir through the air inlet by a capillary action.

As shown in FIG. 6, a liquid container 102 of a conventional writing utensil is provided with a plurality of split pieces 104 which are formed in layers at a regular distance on an outer periphery of the container 102, and an air inlet 110 which is formed by cutting vertically a part of the split pieces 104.

However, when the inner pressure of a liquid reservoir 106 which is mounted on the container 102 happens to rise, the writing liquid in the reservoir 106 easily flows out through the air inlet 110. Also, the writing liquid which flows out and stays temporarily at the gaps between the respective split pieces 104 can not entirely return to the reservoir 106 and remains still, even when the inner pressure of the reservoir 106 becomes normal.

If the above staying phenomenon of the liquid is repeated and a large amount of liquid remains at the gaps between the split pieces 104, the writing liquid is oversupplied to a liquid conveying line 112. As a result, the writing liquid gathers at the point of a writing tip 108, or leaks outside of the writing utensil through the air inlet 110, to thereby stain a user's hands or clothes.

In addition, in order to solve the remaining problem of the writing liquid, the split pieces may be formed more minutely, however, the manufacturing process of the metal mold for shaping the split pieces is complex and the cost is high.

SUMMARY OF THE INVENTION

It is an object of the present invention to provide a writing utensil with a container for receiving temporarily a writing liquid which has a good liquid containing capability and is simplified in structure whereby the manufacturing process is facilitated and the rate of inferior goods is minimized.

In order to achieve the above object, the present invention provides a writing utensil comprising a liquid reservoir for storing a writing liquid; a cylindrical liquid container including a large diameter part which is forcedly inserted into the liquid reservoir and a small diameter part which is integrally formed at a bottom end of the large diameter part, the large and small diameter parts being provided with a liquid supplying passage formed along the central axes of the large and small diameter parts; a liquid conveying line, an upper portion of which is inserted in the liquid supplying passage and a lower portion of which is exposed outside of the liquid container; a housing which is coupled to a bottom of the liquid reservoir and accommodates the liquid container and the liquid conveying line; and a writing tip which is attached to a bottom of the housing.

A plurality of liquid staying pieces are formed on the outer periphery of the large diameter part by splitting the large diameter part in layers at a regular distance, the liquid staying pieces providing spaces therebetween for receiving the writing liquid.

A through-hole is formed at a wall of the large diameter part for communicating the space between the lowermost liquid staying piece and the bottom end of the large diameter part with the liquid supplying passage.

Upward guiding slits are formed vertically in a straight line at the liquid staying pieces.

A tension generating space is formed on the outer periphery of the large diameter part diametrically opposite to the upward guiding slits by cutting longitudinally the parts of the bottom end of the large diameter part and the liquid staying pieces except for the uppermost staying piece.

A pair of downward guiding protrusions are formed longitudinally in the tension generating space and provide a downward guiding groove therebetween.

A downward guiding slit is formed at the uppermost liquid staying piece, the downward guiding slit being in alignment with the downward guiding groove.

Preferably, the height of the space formed between the respective liquid staying pieces is in the range of 0.2 to 0.6 mm.

The writing utensil further comprises a liquid absorbing member which contactingly surrounds the outer peripheral surfaces of the small diameter part and the liquid conveying line.

The liquid absorbing member is implemented as a plurality of absorbing rings into which the small diameter part and the exposed portion of the liquid conveying line are inserted, or as a single absorbing sheet which adhesively surrounds the small diameter part and the exposed portion of the liquid conveying line.

The absorbing ring or the absorbing sheet is made from a material selected from the group consisting a sponge, a felt, a textile fabric and a non-woven fabric.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

Figure 1:
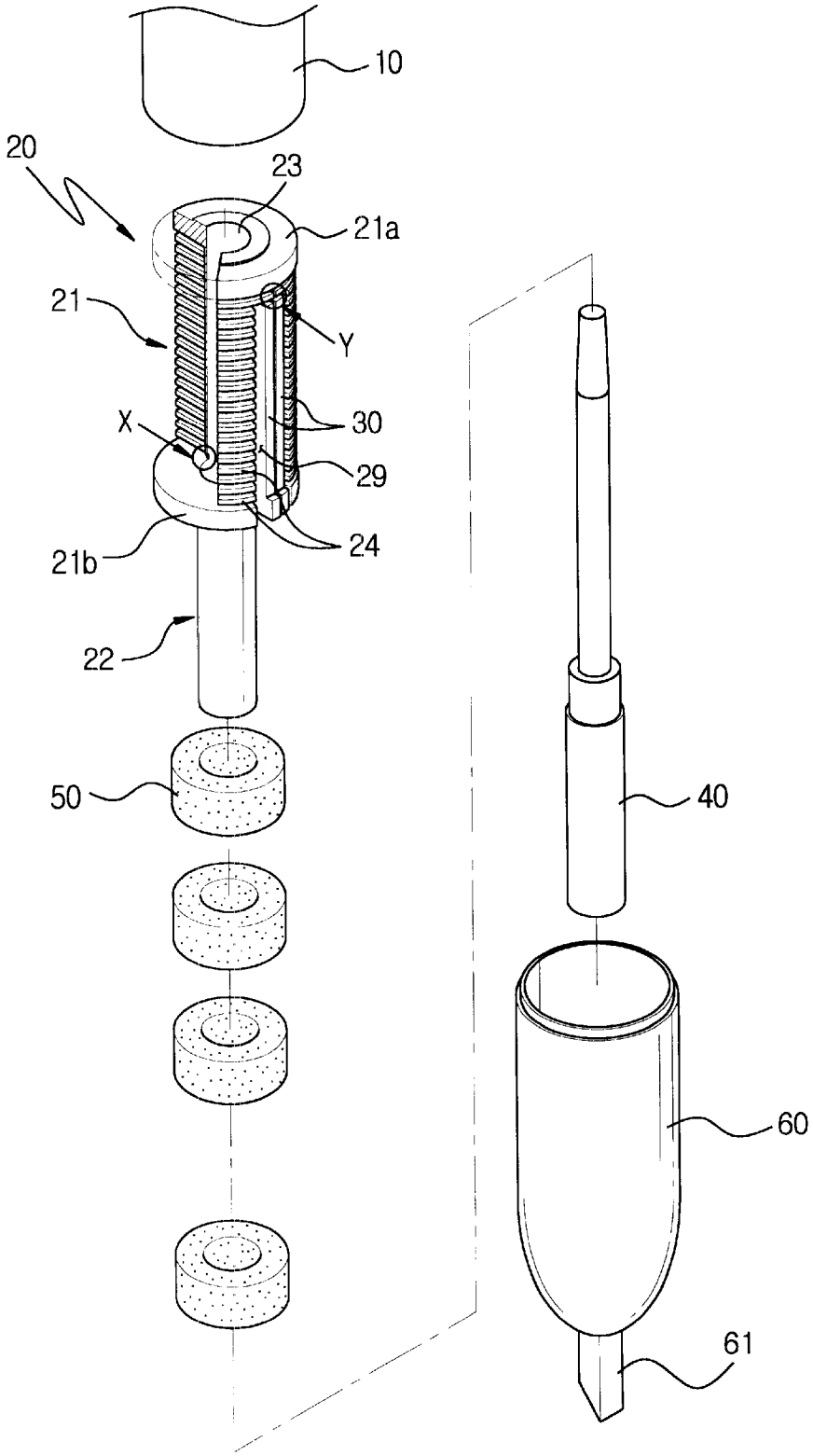
FIG. 1 is an exploded perspective view of a writing utensil with a container for receiving temporarily a writing liquid according to a preferred embodiment of the present invention.
Figure 1A:
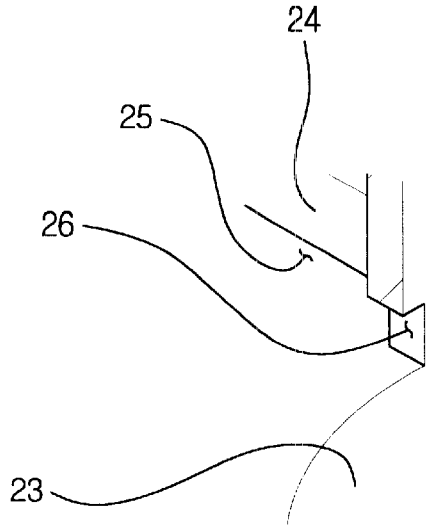
FIG. 1A is an enlarged view of section X of FIG. 1.
Figure 1B:
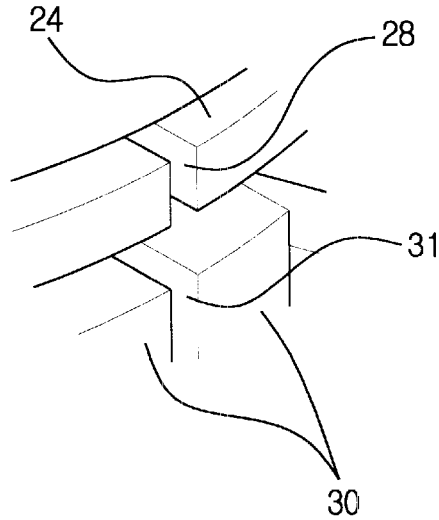
FIG. 1B is an enlarged view of section Y of FIG. 1.

Preferred embodiments of the present invention will now be described in detail with reference to the accompanying drawings.

As shown in FIGS. 1 to 4, a writing utensil according to a preferred embodiment of the present invention includes a cylindrical liquid reservoir 10 for storing a writing liquid and a liquid container 20 in which the writing liquid overflowing from the reservoir 10 is received temporarily and which is forced into an opened bottom end of the liquid reservoir 10. The liquid container 20 is formed in a pipe shape having a liquid supplying passage 23 along its central axis. An upper portion of a liquid conveying line 40 is inserted in the supplying passage 23, and the remainder, i.e., a lower portion of the conveying line 40, is exposed outside of the liquid container 20. The conveying line 40 guides the writing liquid toward a writing tip 61.

Sometimes, the writing liquid overflows from the liquid reservoir 10 due to a rise in the inner pressure of the liquid reservoir 10 or an exterior shock. The overflowing liquid stays in the cylindrical liquid container 20 temporarily.

Such a cylindrical liquid container 20 comprises a large diameter part 21 which is forcedly inserted into the liquid reservoir 10, and a small diameter part 22 which is integrally formed at the bottom end of the large diameter part 21. The liquid supplying passage 23 is formed along the central axes of the large and small diameter parts 21 and 22.

Contacting flanges 21*a* and 21*b* are protrudingly formed around the outer surfaces of the top and bottom portions of the large diameter part 21. These contacting flanges 21*a* and 21*b* closely contact with the inner surface of the liquid reservoir 10 to maintain airtightness.

A plurality of liquid staying pieces 24 are formed between the upper and lower contacting flanges 21*a* and 21*b* on the outer periphery of the large diameter part 21 by splitting the large diameter part 21 in layers at a regular distance. Each gap 25 formed between the respective liquid staying pieces 24 provides a space for receiving temporarily the writing liquid overflowing from the liquid reservoir 10. Preferably, the height of the gap 25 is in the range of 0.2 to 0.6 mm.

A through-hole 26 is formed between the lower contacting flange 21*b* and the lowermost liquid staying piece 24 at the wall of the large diameter part 21. Thus, the through-hole 26 communicates the lowermost liquid staying space 25 with the liquid supplying passage 23. The writing liquid oversupplied in the passage 23 flows in the lowermost liquid staying space 25 through the through-hole 26.

Figure 2:
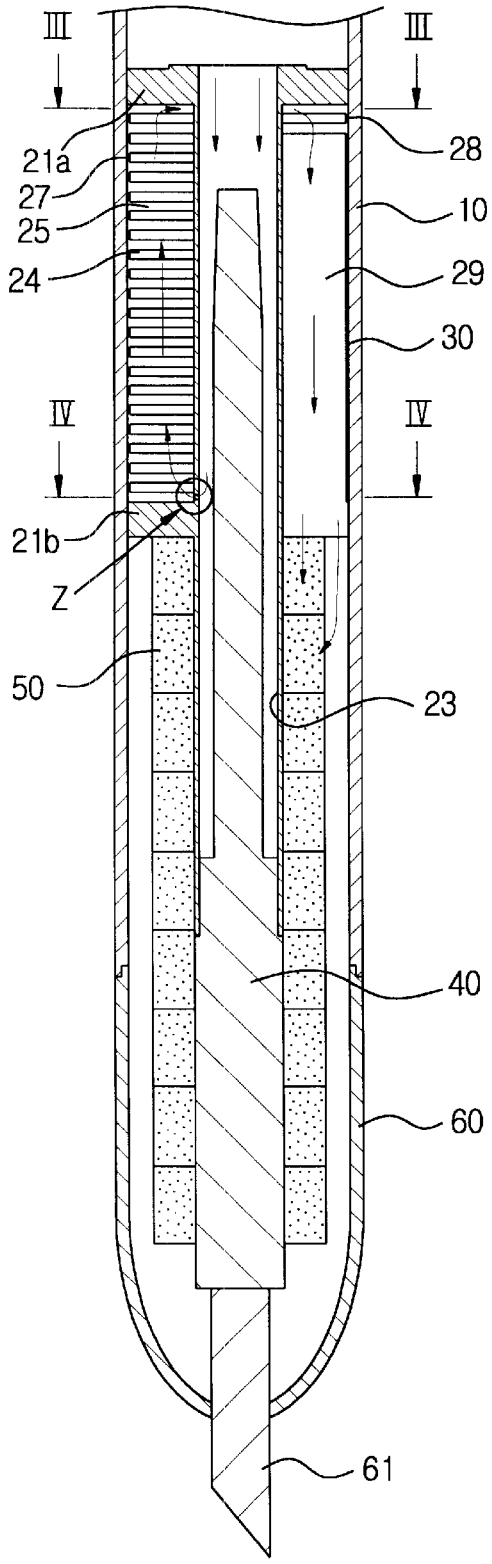
FIG. 2 is a sectional view showing a coupled state of the writing utensil of FIG. 1.
Figure 2A:
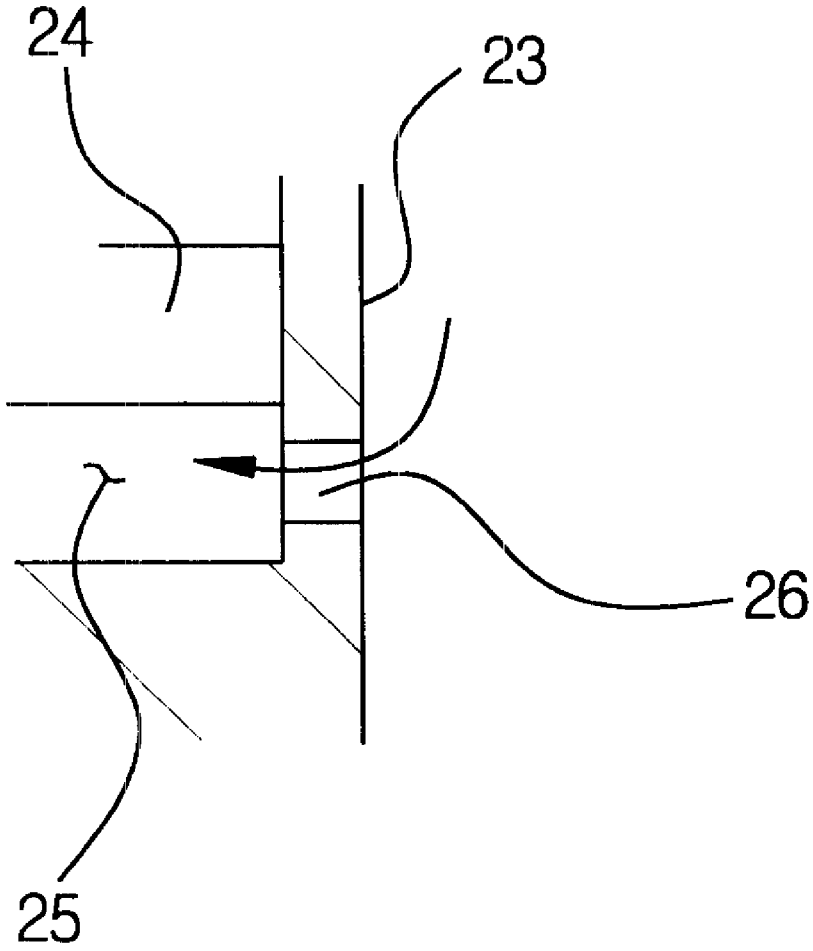
FIG. 2A is an enlarged view of section Z of FIG. 2.
Figure 3:
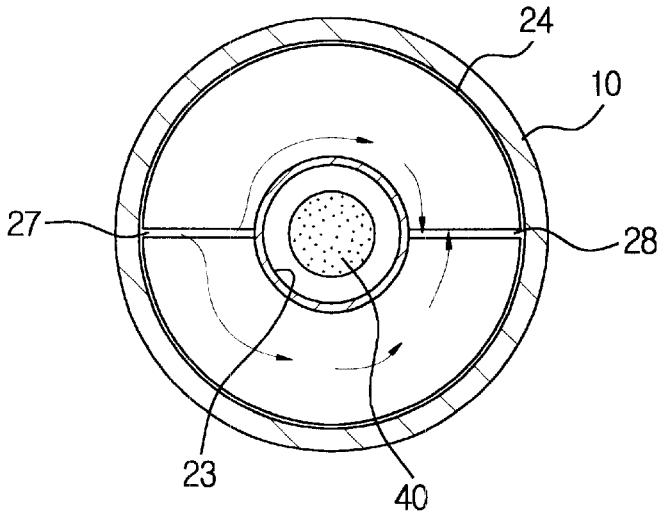
FIG. 3 is a sectional view taken along line III—III of FIG. 2.
Figure 4:
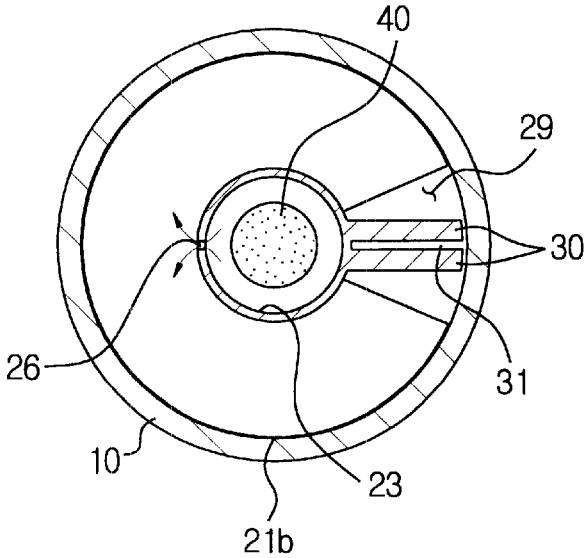
FIG. 4 is a sectional view taken along line IV—IV of FIG. 2.

As shown in FIGS. 2 to 4, upward guiding slits 27 are formed vertically in a straight line at all liquid staying pieces 24. The upward guiding slits 27 communicate the liquid staying spaces 25 with each other.

A tension generating space 29 is formed on the outer periphery of the large diameter part 21 diametrically opposite to the upward guiding slits 27. This tension generating space 29 is formed by cutting longitudinally the parts of the lower contacting flange 21*b* and the liquid staying pieces 24 except for the uppermost staying piece. Above the tension generating space 29, a downward guiding slit 28 equal to the upward guiding slit 27 is formed at the uppermost liquid staying piece 24.

As a result, it is unnecessary to form additionally a passage for guiding the writing liquid staying in the spaces 25 toward the downward guiding slit 28. That is, since the writing liquid can easily flow toward the downward guiding slit 28 by passing through the space 25 between the uppermost staying piece 24 and the upper contacting flange 21*a*, the structure of the liquid container 20 can be significantly simplified, which will be described in detail later.

A pair of downward guiding protrusions 30 are formed longitudinally in the tension generating space 29, and provide a downward guiding groove 31 therebetween. The downward guiding groove 31 is in alignment with the downward guiding slit 28 which is located above the groove 31.

As an auxiliary liquid absorbing member for receiving more of the writing liquid together with the liquid container 20, a plurality of absorbing rings 50 are provided, into which the small diameter part 22 of the liquid container 20 and the exposed lower portion of the liquid conveying line 40 are inserted. The absorbing ring 50 is made from a sponge, a felt, a textile fabric or a non-woven fabric, which has good absorptiveness. Also, the absorbing ring 50 may be shaped by performing a compression molding of one of the above-described materials, so as to improve efficiency of absorbing the writing liquid.

A housing 60 for accommodating the liquid container 20, the liquid conveying line 40 and the absorbing rings 50 is coupled to the bottom of the liquid reservoir 10. The writing tip 61 contacting to the conveying line 40 is attached to the bottom of the housing 60. The writing tip 61 may be embodied as an integral part of the conveying line 40.

Figure 5:
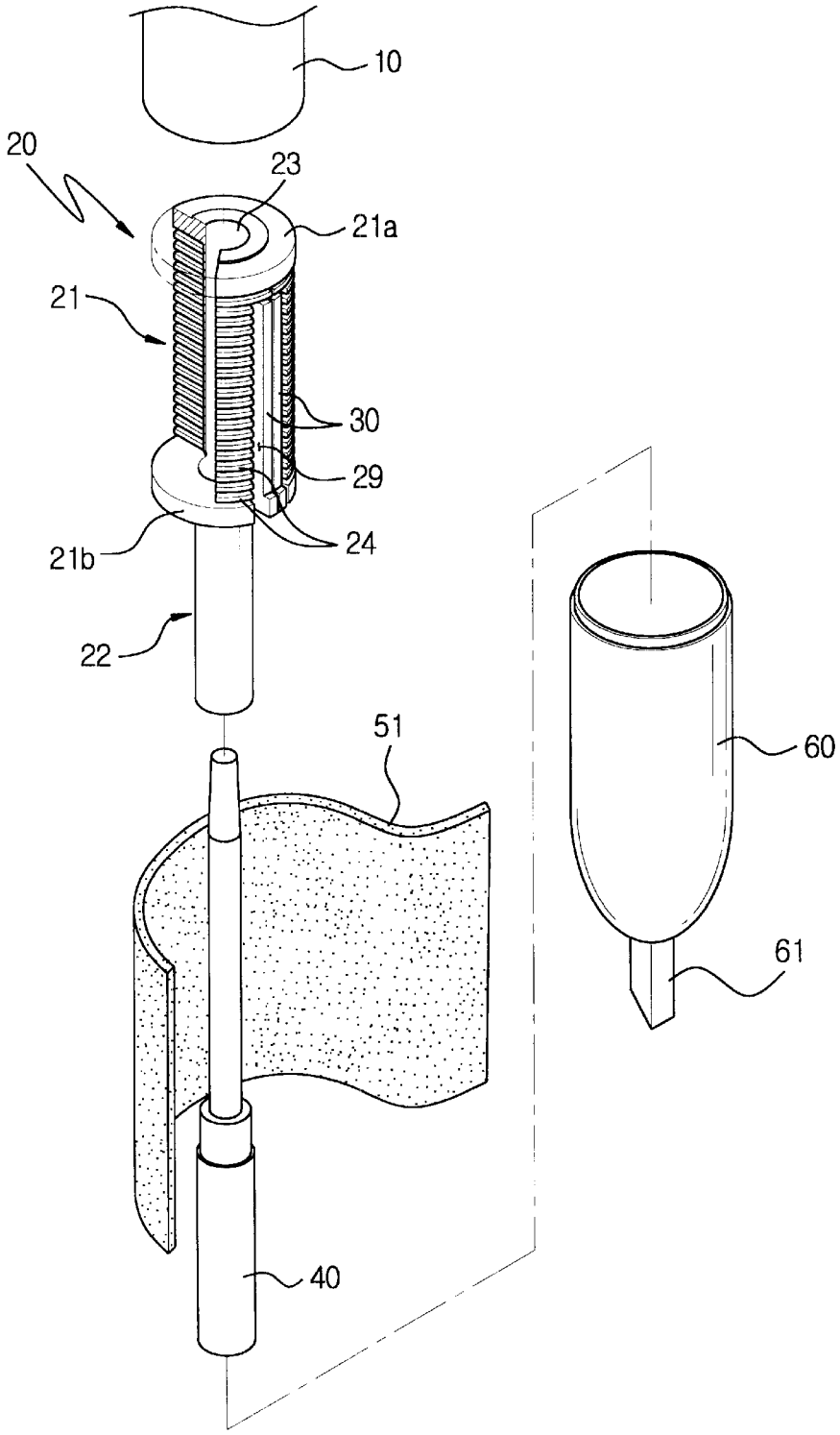
FIG. 5 is an exploded perspective view of a writing utensil with a container for receiving temporarily a writing liquid according to another preferred embodiment of the present invention.
Figure 6:
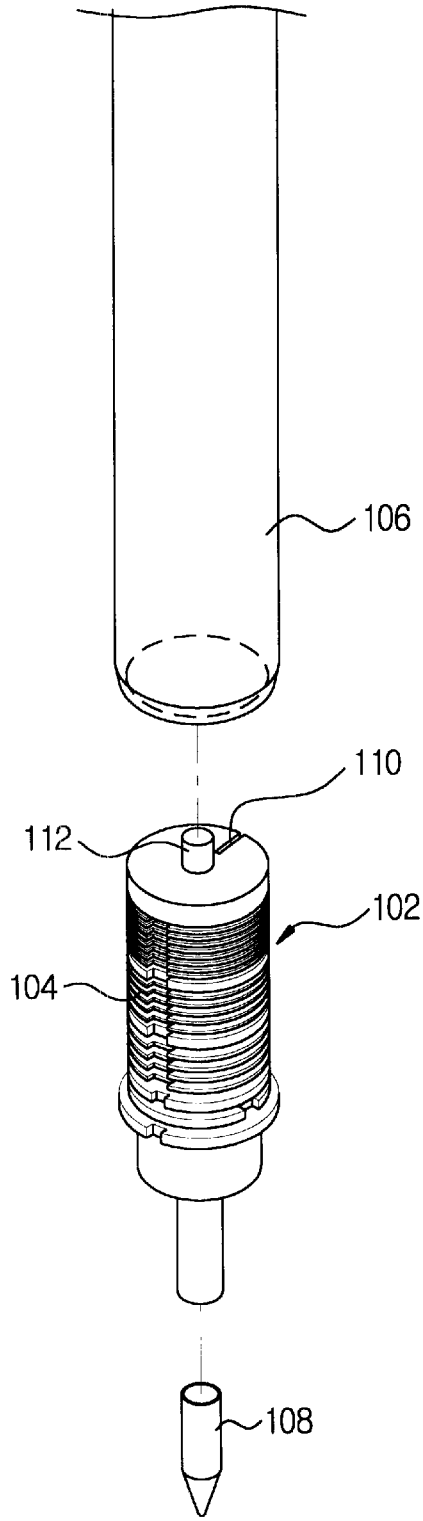
FIG.6 PRIOR ART
FIG. 6 is a perspective view of a conventional writing utensil with a container for receiving temporarily a writing liquid.

Instead of the plural absorbing rings 50, as shown in FIG. 5, a single absorbing sheet 51 which is made from the same material as that of the absorbing ring 50 can be provided. The absorbing sheet 51 has a specific length and a width adequate to surround the small diameter part 22 of the liquid container 20 and the exposed lower portion of the liquid conveying line 40, and adheres thereto by a bonding agent, etc.

The operation and effect of the writing utensil with a container for receiving temporarily a writing liquid according to preferred embodiments of the present invention will now be described hereinafter.

Because of the rise in the inner pressure of the liquid reservoir 10 due to a rise in the inner temperature or an exterior shock, the writing liquid in the reservoir 10 may be oversupplied to the liquid supplying passage 23. The oversupplied liquid flows into the space 25 formed between the lower contacting flange 21*b* and the lowermost staying piece 24 through the through-hole 26 formed at the large diameter part 21 of the liquid container 20, as shown by the direction of arrows in FIG. 4.

In this state, if the inner pressure of the reservoir 10 decreases and is restored to normal, the liquid in the spaces 25 between the staying pieces 24 returns to the reservoir 10 through the through-hole 26 and the supplying passage 23 by the capillary action.

However, when the writing liquid is continually oversupplied due to the above-described disturbances like the exterior shock, the liquid moves upward along the upward guiding slits 27 formed at all the staying pieces 24, and then stays in the spaces 25 between the pieces 24. On the other hand, although the liquid staying in the spaces 25 moves toward the tension generating space 29 formed diametrically opposite to the upward guiding slits 27, the liquid can not reach the tension generating space 29 because of the surface tension generated between the respective staying pieces 24 and the space 29.

If the liquid is further oversupplied, the liquid reaches the liquid staying space 25 between the upper contacting flange 21*a* and the uppermost staying piece 24, and then flows toward the downward guiding slit 28 formed at the uppermost staying piece 24 diametrically opposite to the upward guiding slits 27, as shown by the direction of arrows in FIG. 3. The liquid flows down along the downward guiding slit 28 and the downward guiding groove 31 formed between two downward guiding protrusions 30 in the tension generating space 29.

The liquid flowing down from the large diameter part 21 of the liquid container 20 through the groove 31 is absorbed in the plural absorbing rings 50 which are provided around the small diameter part 22.

Also, a part of the liquid which is oversupplied from the reservoir 10 is absorbed in the liquid conveying line 40. But, since some absorbing rings 50 contactingly surround the lower portion of the liquid conveying line 40 which is exposed from the liquid container 20, the excess of the liquid is absorbed in the rings 50. Accordingly, the optimum quantity of the liquid is supplied to the writing tip 61.

In addition, as shown in FIG. 5, by means of the single absorbing sheet 51 contactingly surrounding the small diameter part 22 of the liquid container 20 and the exposed lower portion of the liquid conveying line 40 instead of the plural absorbing rings 50, the same liquid absorbing effect can be acquired.

As described above in detail, the writing utensil according to the present invention has a simple-structured container for receiving temporarily a writing liquid oversupplied from a reservoir and returning the liquid to the reservoir, so the manufacturing process is facilitated and the rate of the inferior goods is minimized. Also, by providing simple-shaped absorbing rings or sheet under the liquid container as an auxiliary liquid absorbing member, the oversupplied writing liquid can be more efficiently prevented from flowing outside of the writing utensil.

Although various embodiments which incorporate the teachings of the present invention have been shown and described in detail herein, those skilled in the art can readily devise many other varied embodiments that still incorporate these teachings.

What is claimed is:

1. A writing utensil, comprising:

a liquid reservoir for storing a writing liquid;

a cylindrical liquid container including a large diameter part which is forcedly inserted into the liquid reservoir and a small diameter part which is integrally formed at a bottom end of the large diameter part, the large and small diameter parts being provided with a liquid supplying passage formed along the central axes of the large and small diameter parts;

a liquid conveying line, an upper portion of which is inserted in the liquid supplying passage and a lower portion of which is exposed outside of the liquid container;

a housing which is coupled to a bottom of the liquid reservoir and accommodates the liquid container and the liquid conveying line; and a writing tip which is attached to a bottom of the housing, wherein a plurality of liquid staying pieces are formed on the outer periphery of the large diameter part by splitting the large diameter part in layers at a regular distance, the liquid staying pieces providing spaces therebetween for receiving the writing liquid, a through-hole is formed at a wall of the large diameter part for communicating the space between the lowermost liquid staying piece and the bottom end of the large diameter part with the liquid supplying passage, upward guiding slits are formed vertically in a straight line at the liquid staying pieces, a tension generating space is formed on the outer periphery of the large diameter part diametrically opposite to the upward guiding slits by cutting longitudinally the parts of the bottom end of the large diameter part and the liquid staying pieces except for the uppermost staying piece, a pair of downward guiding protrusions are formed longitudinally in the tension generating space and provide a downward guiding groove therebetween, and a downward guiding slit is formed at the uppermost liquid staying piece, the downward guiding slit being in alignment with the downward guiding groove.

2. The writing utensil as claimed in claim 1, wherein contacting flanges are protrudingly formed around the outer surfaces of the top and bottom end's of the large diameter part, the contacting flanges closely contact with the inner surface of the liquid reservoir to maintain airtightness.

3. The writing utensil as claimed in claim 1, wherein the height of the space formed between the respective liquid staying pieces is in the range of 0.2 to 0.6 mm.

4. The writing utensil as claimed in claim 1, wherein the writing utensil further comprises a liquid absorbing member which contactingly surrounds the outer peripheral surfaces of the small diameter part and the liquid conveying line.

5. The writing utensil as claimed in claim 4, wherein the liquid absorbing member is implemented as a plurality of absorbing rings into which the small diameter part and the exposed portion of the liquid conveying line are inserted.

6. The writing utensil as claimed in claim 5, wherein the absorbing ring is made from a material selected from the group consisting a sponge, a felt, a textile fabric and a non-woven fabric.

7. The writing utensil as claimed in claim 4, wherein the liquid absorbing member is implemented as a single absorbing sheet which adhesively surrounds the small diameter part and the exposed portion of the liquid conveying line.

8. The writing utensil as claimed in claim 7, wherein the absorbing sheet is made from a material selected from the group consisting a sponge, a felt, a textile fabric and a non-woven fabric.

* * * * *